United States Patent [19]

Kosson et al.

[11] Patent Number: 4,609,034

[45] Date of Patent: Sep. 2, 1986

[54] INFRARED CAMOUFLAGE SYSTEM

[75] Inventors: Robert Kosson, Massapequa; Jonas Bilenas, Melville; Salvatore Attard, Huntington; Theodore Hilgeman, Centerport, all of N.Y.

[73] Assignee: Grumman Aerospace Corporation, Bethpage, N.Y.

[21] Appl. No.: 601,150

[22] Filed: Apr. 17, 1984

[51] Int. Cl.[4] ..... F41H 3/00

[52] U.S. Cl. ..... 165/1; 165/47; 89/36.01; 250/352; 374/121; 374/129

[58] Field of Search ..... 165/47, 1; 89/36 R; 250/252.1, 352; 374/121, 129, 159

[56] References Cited

U.S. PATENT DOCUMENTS

| | | | |
|---|---|---|---|
| 2,846,882 | 8/1958 | Gray | 374/129 |
| 4,413,668 | 11/1983 | Allard | 165/47 |
| 4,433,924 | 2/1984 | Quinn, III | 374/129 |
| 4,435,092 | 3/1984 | Iuchi | 250/338 R |
| 4,463,653 | 8/1984 | Pusch et al. | 89/36 R |

FOREIGN PATENT DOCUMENTS

| | | | |
|---|---|---|---|
| 2848072 | 5/1980 | Fed. Rep. of Germany | 89/36 R |

*Primary Examiner*—Albert W. Davis, Jr.
*Assistant Examiner*—John K. Ford
*Attorney, Agent, or Firm*—Pollock, VandeSande & Priddy

[57] ABSTRACT

Military mechanical field equipment, such as an electrical generator, is camouflaged from airborne IR detection by enclosing the equipment in a double-walled enclosure having hollow walls through which air is forced to flow. By adjusting the air flow in the enclosure, the radiance from the enclosure can be made the same as its immediate surroundings. A dual temperature sensor senses temperature differences between the enclosure surface and the surroundings and varies the air cooling accordingly until thermal balance is achieved.

10 Claims, 5 Drawing Figures

INFRARED CAMOUFLAGE SYSTEM

BRIEF DESCRIPTION OF THE PRIOR ART

Infrared detection of ground military equipment, when viewed against a cluttered background, depends on an effective radiant temperature difference (contrast $\Delta T$) between equipment and adjacent background surfaces. Usually contrast $\Delta T$ must be limited to about 4° or 5° C. in such a way that this limit is maintained against any background (soil, grass, trees, etc.) and at all atmospheric conditions including solar heating, wind cooling and intermittent cloud passage. It is evident from FIG. 1 that effective radiant temperatures of different backgrounds differ from each other as much as 20° C. or even 30° C. when air background is considered. For this reason the required contrast $\Delta T$ limits cannot be achieved for all backgrounds when customary surface coating (passive emissivity control) methods are used.

It is a primary purpose of the present invention to provide an active temperature control of military ground equipment surfaces in order to deny their recognition by infrared imaging sensors as is frequently accomplished by airborne or satellite surveillance instrumentation.

BRIEF DESCRIPTION OF THE PRESENT INVENTION

The present system preferably utilizes an air-cooled and/or air-heated enclosure which encloses equipment in a double-walled enclosure having hollow walls through which air is forced to flow. In a typical embodiment, such as explored herein, such an enclosure is intended for a gas turbine driven electrical ground generator set. Air is drawn through the hollow double-walled enclosure by the intake suction of a generator set air compressor. A diverter valve adjusts the airflow through the hollow walls so that the radiance from the enclosure matches that of background radiance. A radiometric sensor is mounted on a mast, above the enclosure and detects differences in apparent radiance between the exterior of the enclosure and the background thereby generating a difference signal which drives a motor and coupled diverter valve until balance is obtained.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE PRESENT INVENTION

Figure 1:
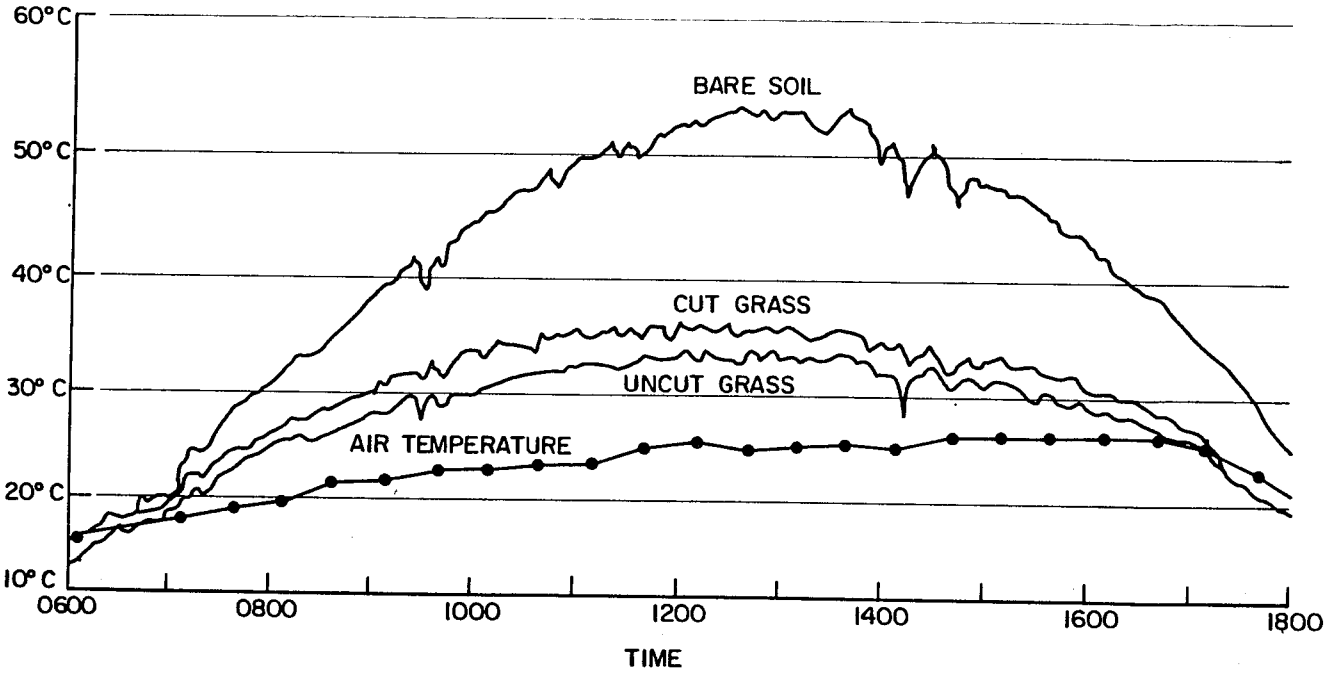
FIG. 1 is a plot of ambient background thermal transients.

FIG. 1 illustrates ambient background thermal transients for a number of different types of background environments including grass and soil. Although the air temperature plot demonstrates slow changes in temperature as a function of time, the plots of cut grass, uncut grass and bare soil indicate that the radiance from these backgrounds have transient responses, which may be due to changing wind conditions or passing clouds. Further, FIG. 1 illustrates that the effective radiant temperatures of different backgrounds differ from each other as much as 20° C. or as much as 30° C. when air background is considered. The direction of the temperature difference can also reverse, with surfaces running colder than the air at night or during periods of low solar insolation.

In order for an IR active camouflage system to be effective, it must simulate the thermal transients of natural background in the vicinity of camouflaged military field equipment. As previously mentioned, the temperature contrast between the natural background and the equipment must be limited to a small value, for example, about 4° or 5° C., in such a way that this limit is maintained against any background and all atmospheric conditions.

Figure 2:
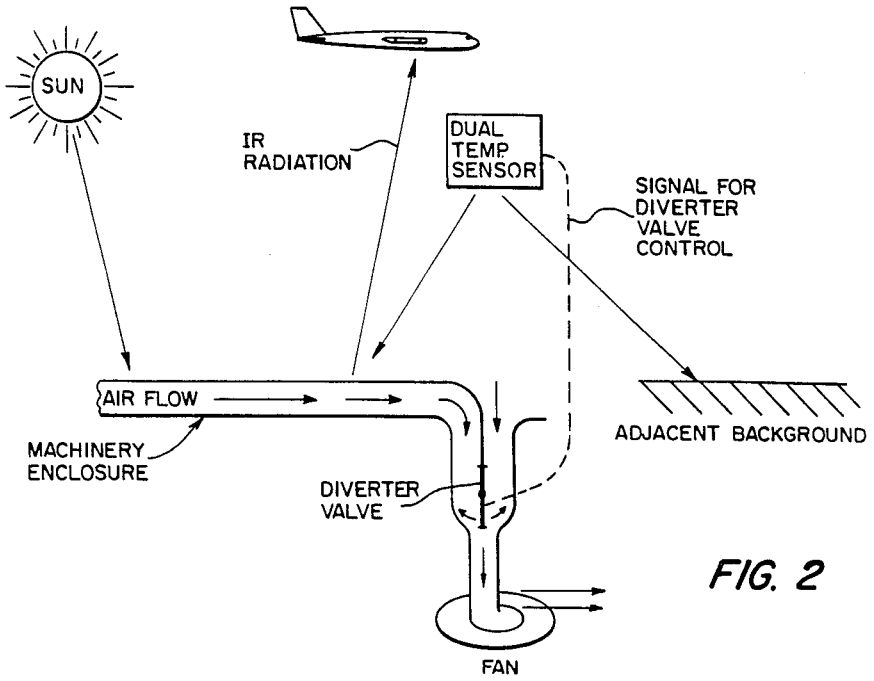
FIG. 2 is a simplified conceptual diagram of the present invention.

FIG. 2 is intended to introduce the basic concept of the invention. A machinery enclosure which is located in an area of military operations becomes heated from solar radiation or by heat generated from internal components and may be detected by surveillance aircraft or satellites. In order to effectively camouflage the enclosure from IR recognition, the enclosure is fabricated from a double, hollow wall structure which is air cooled. By varying the airflow of cooling, the surface temperature of the enclosure may be adjusted so that it matches the adjacent natural surrounding or background. A dual temperature sensor is typically mounted on a mast, above the enclosure so that it may sense radiance from the enclosure and the adjacent background. A difference signal changes the position of a diverter valve which has an immediate effect on the airflow through the enclosure. A fan creates the airflow through the enclosure and in certain applications the dual temperature sensor may control the speed of the fan in lieu of, or in addition to, its control of a diverter valve.

The basic operation of the system as illustrated in FIG. 2 requires greater airflow as the radiance from the enclosure is increased relative to that from the adjacent background. The increased airflow continues until the surface of the enclosure cools down sufficiently to generate radiance which matches the adjacent background within the desired temperature difference of 4° or 5° C. thereby achieving successful IR camouflage.

Note that the system illustrated in FIG. 2 can also be used to minimize negative contrast between the equipment and background, such as might occur during the night or early morning, when the equipment can be considerably colder than the background. In this situation the air is generally warmer than the background, and an increase in airflow can be used to raise the temperature of the enclosure relative to the background. Since this effect is opposite to that of the previously described cooling case, the controller must be designed to take account of the direction of the radiance difference being nulled.

Figure 3:
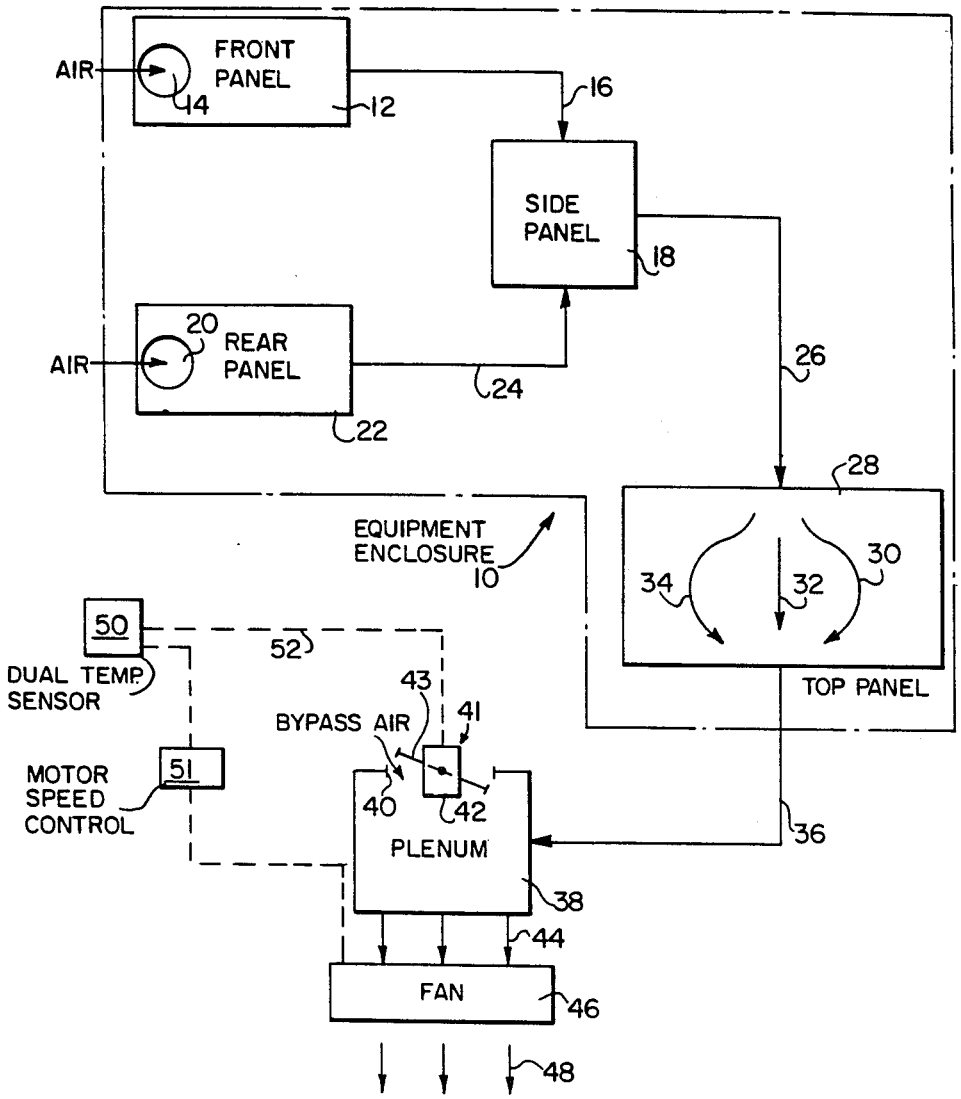
FIG. 3 is a block diagram illustrating airflow and regulation through an enclosure, in accordance with the present invention.

FIG. 3 is a block diagram of the airflow path through a double-walled, hollow equipment enclosure which might typically enclose a gas turbine driven electrical ground generator set. However, it is to be stressed that the present invention is applicable to all types of vehicles and transportable equipment used in the field of military operations and which generate IR signatures which may be detected by enemy surveillance. In FIG. 3 the enclosure panels are diagrammatically shown as separated. However, as will be appreciated, the enclosure panels are actually contiguous.

Equipment enclosure 10 typically includes front panel 12 which in reality is a hollow, double-walled panel with an air inlet 14 formed therein. Air is forced into the interior passageway between the walls of panel 12 and flows along the length of the panel, as indicated by reference numeral 16, to side panel 18. Similarly, a rear panel 22 has an air inlet 20 formed therein to permit airflow through the entire length of the rear panel 22, as diagrammatically illustrated by reference numeral 24. The collected airflow in side panel 18 is deflected, as indicated by reference numeral 26, to a top panel 28, which likewise has a double-hollow wall construction. The top panel 28 has vanes or mechanical stiffeners, to be discussed hereinafter, which distribute the airflow throughout the entire volume of the top panel as indicated by airflow lines 30, 32 and 34.

It should be understood that the airflow thus described is entirely within the panels of the equipment enclosure and that reference numerals 16, 24 and 26 are not intended to indicate that air flowing between the various panels are externally routed.

The air flowing through top panel 28 is collected, as indicated by reference numeral 36, and empties into a plenum 38. A separate orifice 40 is formed in plenum 38 to allow bypass air to enter in accordance with the position of a diverter valve 43 driven by a servo motor 42, the latter two devices constituting the assembly generally indicated by reference numeral 41. The diverter valve position is determined from a dual temperature sensor 50 which operates as previously explained in connection with FIG. 2. By way of example, a fan 46 may be interposed in the airflow path 44, at the outlet of plenum 38, followed by an exhaust 48. In an alternate embodiment of the invention, the dual temperature sensor may drive a fan motor speed control 51 thereby governing flow rate.

In many actual applications the use of a separate fan, such as 46, is unnecessary. For example, in the event enclosed equipment is a generator set, the engine air inlet assembly of the generator set creates the airflow.

Figure 4:
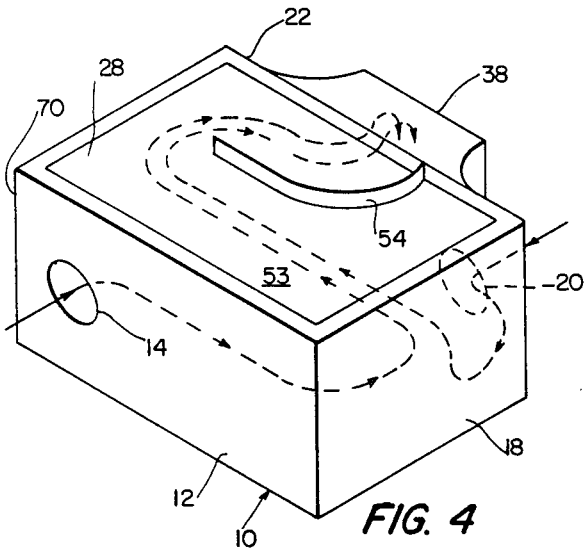
FIG. 4 is a simplified perspective view of an enclosure as utilized in the present invention.

FIG. 4 is a simplified perspective view of a double-walled hollow enclosure in accordance with the present invention. Reference numerals denoting the same structural components in FIGS. 3 and 4 are identically numbered. The plenum 38 is seen to be appended from the rear panel 22 of the enclosure 10. Air flowing over the top edge of side panel 18 traverses the length of top panel 28 and is guided by the vane or stiffener 54 in the direction of the plenum entrance. Use of stiffener 54 ensures the maximum flow across the length of the top panel before redirection into the plenum. In addition, the stiffener 54 acts as a structural reinforcement between one illustrated wall 53 of panel 28 and an overlaying wall (not illustrated) which would complete the hollow double-walled top panel 28. It is to be understood that each of the air-cooled panels may have internal vanes to guide the airflow and provide structural stiffening similar to that described for top panel 28.

Figure 5:
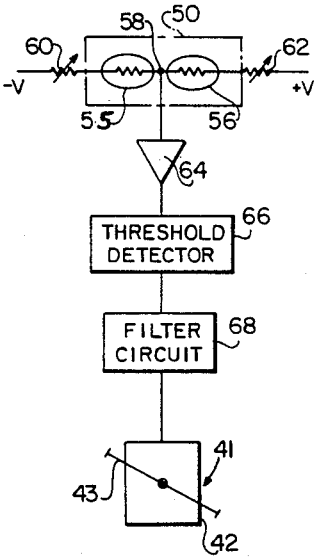
FIG. 5 is a block diagram of a diverter valve control circuit.

FIG. 5 illustrates a block diagram for a control circuit connected between the dual temperature sensors 50 and the valve-motor assembly 41. In particular, two prior art IR sensor sections 55 and 56 are interconnected at a junction 58. Separate variable resistors 60 and 62 are connected between respective voltage potentials and IR sensor sections 55 and 56. An operational amplifier 64 is connected at its input to junction 58 and at its output to a conventional threshold detector 66. In order to prevent oscillations in the control circuit, a filter circuit 68 is interposed between a conventional servo motor 42 and the threshold detector 66. After filtering, a drive signal from the threshold detector 66 directs the diverter valve 43 in a direction to achieve greater or lesser airflow through the enclosure in order to change the radiance thereof to match the background as detected by the dual temperature sensor.

It should be noted that FIGS. 3 and 4 illustrate air cooling through double-hollow walls of only four enclosure panels in order to simplify the view. In many applications the second end panel 70 (FIG. 4) is fabricated in the form of a double-hollow wall which communicates with the air flowing through the other panels.

In actual fabrication of the enclosure, quick release screws and standoffs may support the panels and, combined with the low weight of each panel, permit easy removal when access to enclosed equipment is required. The air passages between panels preferably have self-sealing gaskets to prevent air leakage when panels are in place.

A design criterion should ensure that the panels cover as much of the exposed surface of enclosed equipment as possible without interferring with its operation. Control panels for equipment and areas where electrical, fuel and oil connections are made should not be covered. However, these areas constitute only a small portion of the total surface area of an enclosure and should have little effect on the composite IR signature.

Although the previous discussion of the invention discusses the use of an air-cooled enclosure, the invention and the claims directed thereto include other gas or liquid cooling by means known in the art.

It should be understood that the invention is not limited to the exact details of construction shown and described herein for obvious modifications will occur to persons skilled in the art.

We claim:

1. An enclosure for camouflaging enclosed equipment from IR detection, the enclosure comprising:

at least one enclosure panel having hollow wall construction defining a passageway through which cooling fluid flows;

means for forcing fluid flow through the passageway;

IR sensing means located in proximity to the surface of the enclosure for measuring radiance from the surface and from adjacent background;

adjusting means communicating with the passageway for adjusting the fluid flow therethrough, said adjusting means further adjusting the flow of supplementary cooling fluid admitted at the exit of the passageway;

means connected between the sensing means and the adjusting means for changing the adjusting means until the measured radiance from the surface and the adjacent background are substantially matched.

2. The structure set forth in claim 1 wherein the enclosure is comprised of a plurality of panels having hollow walls with communicating passageways.

3. The enclosure of claim 1 wherein the adjusting means comprises a valve located in the fluid flow path.

4. The enclosure of claim 3 wherein the means for changing the adjusting means comprises a motor having its input connected in circuit with the sensing means and its output coupled to the adjusting means for changing the position thereof.

5. An enclosure for camouflaging enclosed equipment to avoid detection during IR surveillance, the enclosure comprising:

a plurality of hollow double-walled panels, each defining an air passageway therethrough which communicates with other panel passageways;

means for forcing airflow through the passageways;

IR sensing means located in proximity to the surface of the enclosure for measuring radiance from the surface and from adjacent background;

a valve means located in a flow path communicating with the passageways for adjusting airflow therethrough and for admitting supplementary air at the exits thereof;

a motor having its input connected in circuit with the sensing means and its output connected to the valve means for varying the airflow and the amount of supplementary air in response to a signal generated from the sensing means until the measured radiance from the enclosure surface and the adjacent background are substantially matched.

6. The enclosure set forth in claim 5 together with at least one member structurally connected between two corresponding walls of at least one double-walled panel for reinforcing the panel and serving as an airflow vane therethrough.

7. An enclosure for camouflaging enclosed equipment to avoid detection during IR surveillance, the enclosure comprising:

a plurality of hollow double-walled panels, each defining an air passageway therethrough which communicates with other panel passageways;

means for forcing airflow through the passageways;

IR sensing means located in proximity to the surface of the enclosure for measuring radiance from the surface and from adjacent background;

a valve means located in a flow path communicating with the passageways for adjusting airflow therethrough;

a motor having its input connected in circuit with the sensing means and its output connected to the valve means for varying the airflow in response to a signal generated from the sensing means until the measured radiance from the enclosure surface and the adjacent background are substantially matched;

a plenum having a first inlet communicating with a top enclosure panel and receiving air having passed across the top panel; and a second inlet of the plenum providing supplementary air therethrough;

the valve means located in variable occluding relation to each inlet for adjusting the airflow through the enclosure.

8. The enclosure set forth in claim 7 wherein the sensing means comprises:

dual temperature sensing means for monitoring the enclosure and the background, respectively;

means connected to the sensing means for amplifying a signal indicating a lack of match therefrom; and threshold detecting means connected to an output of the amplifying means for generating a control signal for the motor.

9. A process for camouflaging an equipment enclosure from IR detection comprising the steps:

forcing fluid flow through at least one panel of the enclosure, the panel having hollow wall construction with a passageway defined therethrough;

supplying supplementary air at the exit of the passageway;

sensing the radiance from the enclosure and adjacent background;

adjusting the fluid flow and supplementary air flow until the sensed radiance from the enclosure matches that from the background, within preselected limits.

10. A process for camouflaging an equipment enclosure from IR detection comprising the steps:

forcing fluid flow through at least one panel of the enclosure, the panel having hollow wall construction with a passageway defined therethrough;

sensing the radiance from the enclosure and adjacent background;

adjusting the fluid flow until the sensed radiance from the enclosure matches that from the background, within preselected limits;

wherein the flow is caused by air forced through the panel, and further wherein the airflow through the enclosure exits through a plenum where it is mixed with supplementary air, in a controlled amount, to regulate the airflow through the enclosure.

* * * * *